US011745366B2

(12) United States Patent
Okura et al.

(10) Patent No.: US 11,745,366 B2
(45) Date of Patent: Sep. 5, 2023

(54) COMB-SHAPED OUTER BLADE, BLADE UNIT, AND ELECTRIC RAZOR

(71) Applicant: Panasonic Intellectual Property Management Co., Ltd., Osaka (JP)

(72) Inventors: Shoki Okura, Shiga (JP); Masato Omori, Shiga (JP); Hiroaki Shimizu, Shiga (JP); Shunsuke Komori, Shiga (JP); Atsutaka Ikemoto, Shiga (JP); Daisuke Sone, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/576,314

(22) Filed: Jan. 14, 2022

(65) Prior Publication Data

US 2022/0314470 A1 Oct. 6, 2022

(30) Foreign Application Priority Data

Mar. 30, 2021 (JP) ..... 2021-058802

(51) Int. Cl.
*B26B 19/04* (2006.01)

(52) U.S. Cl.
CPC ..... *B26B 19/04* (2013.01)

(58) Field of Classification Search
CPC ..... B26B 19/02; B26B 19/04; B26B 19/10; B26B 19/12; B26B 19/102; B26B 19/042; B26B 19/142; B26B 19/384
See application file for complete search history.

(56) References Cited

U.S. PATENT DOCUMENTS 2,181,038 A * 11/1939 Wimberger ..... B26B 19/384 30/34.2
2,245,795 A * 6/1941 Landgraf ..... B26B 19/04 30/346.51
2,290,689 A * 7/1942 Law ..... B26B 19/042 76/104.1
2,325,606 A * 7/1943 Hanley ..... B26B 19/042 30/41.6

(Continued)

FOREIGN PATENT DOCUMENTS

AT 521184 A1 * 11/2019 ..... B26B 19/042
JP 2006-247146 A 9/2006
JP 2019-511336 A 4/2019

*Primary Examiner* — Laura M Lee
(74) *Attorney, Agent, or Firm* — McDermott Will & Emery LLP

(57) ABSTRACT

A comb-shaped outer blade that scoops up body hair while suppressing the damage to the skin. The comb-shaped outer blade includes a base part that has a rod shape and extends in a first direction, a comb-blade attachment part that has a plate shape and extends in the first direction and a second direction, open blade parts each of which has a cantilever shape and protrudes from base part in a third direction, and bent blade parts arranged alternately with the open blade parts in the first direction, the bent blade parts connecting the base part to the attachment part. Each of the bent blade parts includes a protruding part that protrudes from the base part along the third direction, bent part that is connected to a distal end of the protruding part, and connecting part that connects bent part and comb-blade attachment part in an inclined state.

11 Claims, 13 Drawing Sheets

(56) References Cited

U.S. PATENT DOCUMENTS 2,416,094 A * 2/1947 Gray ..... B26B 19/384
72/340
2,758,370 A * 8/1956 Gray ..... B26B 19/04
30/43.92
2,915,816 A * 12/1959 Gray ..... B26B 19/042
30/346.51
4,481,711 A * 11/1984 Pachel ..... B26B 19/384
30/34.1
5,802,932 A * 9/1998 Vankov ..... B26B 19/06
76/104.1
6,293,017 B1 * 9/2001 Sato ..... B26B 19/10
30/346.51
6,308,414 B1 * 10/2001 Parsonage ..... B26B 19/288
30/43.92
6,684,509 B1 * 2/2004 Best ..... B26B 19/102
30/43.92
8,141,254 B2 * 3/2012 Shimizu ..... B26B 19/10
30/43
9,592,613 B2 * 3/2017 Pohl ..... B26B 19/06
9,751,225 B2 * 9/2017 Man Wong ..... B26B 19/06
9,821,478 B2 * 11/2017 Kleine Doepke ..... B26B 19/143
10,906,195 B2 * 2/2021 Bady ..... B26B 19/145
2001/0003870 A1 * 6/2001 Eichhorn ..... B26B 19/38
30/84
2005/0274019 A1 * 12/2005 Inoue ..... B26B 19/10
30/43.7
2007/0101574 A1 * 5/2007 Royle ..... B26B 19/042
30/43.3
2017/0190063 A1 * 7/2017 Schratter ..... B26B 19/042
2017/0312927 A1 11/2017 Erndt et al.
2018/0085933 A1 * 3/2018 Bady ..... B26B 19/20
2020/0376697 A1 * 12/2020 Kondo ..... B26B 19/42
2021/0347072 A1 * 11/2021 Xu ..... B26B 19/12

* cited by examiner

COMB-SHAPED OUTER BLADE, BLADE UNIT, AND ELECTRIC RAZOR

CROSS-REFERENCE OF RELATED APPLICATIONS

This application claims the benefit of Japanese Application No. 2021-058802, filed on Mar. 30, 2021, the entire disclosure of which Application is incorporated by reference herein.

BACKGROUND

1. Technical Field

The present disclosure relates to a comb-shaped outer blade, a blade unit, and an electric razor for shaving body hair of an animal such as a human.

2. Description of the Related Art

Conventionally, as an outer blade used for an electric razor, there is provided a comb-shaped outer blade in which blades protrude like a comb (see, for example, PTL 1). Such a comb-shaped outer blade can easily introduce body hair along a skin surface (so-called flat-lying body hair) between blades of the comb-shaped outer blade. For this reason, among a plurality of types of outer blades attached to the electric razor, the comb-shaped outer blade functions to shave relatively long body hair and flat-lying body hair.

CITATION LIST

Patent Literature

PTL 1: Unexamined Japanese Patent Publication No. 2006-247146

SUMMARY

However, while the comb-shaped outer blade has a high effect of scooping up body hair, the comb-shaped outer blade tends to significantly damage the skin.

The present disclosure has been made in view of the above problems, and an object of the present disclosure is to provide a comb-shaped outer blade, a blade unit comprising the comb-shaped outer blade, and an electric razor comprising the comb-shaped outer blade that reduce the damage to the skin while maintaining a high effect of scooping up body hair.

In order to achieve the above object, a comb-shaped outer blade according to one aspect of the present disclosure is a comb-shaped outer blade configured to be attached to an electric razor, the comb-shaped outer blade comprising a base part that has a rod shape and extends in a first direction, an comb-blade attachment part that has a plate shape and extends in the first direction and a second direction intersecting the first direction, open blade parts each of which has a cantilever shape and protrudes from the base part in a third direction which intersects the first direction and the second direction, and bent blade parts arranged alternately with the open blade parts in the first direction, the bent blade parts connecting the base part to the comb-blade attachment part, wherein each of the bent blade parts comprises a protruding part that protrudes from the base part along the third direction, a bent part that is connected to a distal end of the protruding part and bent at an acute angle, and a connecting part that is inclined so as to approach the base part in the third direction as being separated from the bent part in the second direction and connects the bent part and the comb-blade attachment part.

In order to achieve the above object, a blade unit according to one aspect of the present disclosure is a blade unit for an electric razor, the blade unit being configured to be detachably attached to the electric razor, the blade unit comprising comb-shaped outer blade, a slit inner blade that is disposed inside the comb-shaped outer blade, and a comb-blade holding member that holds the slit inner blade so as to be able to reciprocate with respect to the comb-shaped outer blade, the comb-shaped outer blade comprising a base part that has a rod shape and extends in a first direction, an comb-blade attachment part that has a plate shape and extends in the first direction and a second direction intersecting the first direction, open blade parts each of which has a cantilever shape and protrudes from the base part in a third direction which intersects the first direction and the second direction, and bent blade parts arranged alternately with the open blade parts in the first direction, the bent blade parts connecting the base part to the comb-blade attachment part, wherein each of the bent blade parts comprises a protruding part that protrudes from the base part along the third direction, a bent part that is connected to a distal end of the protruding part, and a connecting part that is inclined so as to approach the base part in the third direction as being separated from the bent part in the second direction and connects the bent part and the comb-blade attachment part.

In order to achieve the above object, an electric razor according to one aspect of the present disclosure comprises a comb-shaped outer blade comprising a base part that has a rod shape and extends in a first direction, an comb-blade attachment part that has a plate shape and extends in the first direction and a second direction intersecting the first direction, open blade parts each of which has a cantilever shape and protrudes from the base part in a third direction which intersects the first direction and the second direction, and bent blade parts arranged alternately with the open blade parts in the first direction, the bent blade parts connecting the base part to the comb-blade attachment part, wherein each of the bent blade parts comprises a protruding part that protrudes from the base part along the third direction, a bent part that is connected to a distal end of the protruding part, and a connecting part that is inclined so as to approach the base part in the third direction as being separated from the bent part in the second direction and connects the bent part and the comb-blade attachment part.

According to the present disclosure, with the shape of the blade having a distal end bent to hold the comb-shaped outer blade, it is possible to achieve both a high effect of scooping up body hair and reduction of the damage to the skin.

DETAILED DESCRIPTION

Hereinafter, an exemplary embodiment of a comb-shaped outer blade, a blade unit, and an electric razor according to the present disclosure will be described with reference to the drawings. Note that the following exemplary embodiment is an example for describing the present disclosure, and is not intended to limit the present disclosure. For example, a shape, a structure, a material, a component, a relative positional relationship, a connection state, a numerical value, a mathematical expression, the contents of each step and the order of the individual steps in a method, and the like described in the following exemplary embodiment are merely examples, and may include the contents that are not described below. In addition, geometric expressions such as parallel and orthogonal may be used, but these expressions do not indicate mathematical strictness, and include substantially acceptable errors, deviations, and the like. Furthermore, expressions such as simultaneous and identical include substantially acceptable ranges.

Moreover, the drawings are schematic views in which emphasis, omission, and ratio adjustment have been appropriately performed in order to describe the present disclosure, and may have shapes, positional relationships, and ratios that are different from actual shapes, positional relationships, and ratios.

Further, in the following, a plurality of aspects may be comprehensively described as one exemplary embodiment. In addition, some of the contents described below are described as optional components related to the present disclosure.

Figure 1:
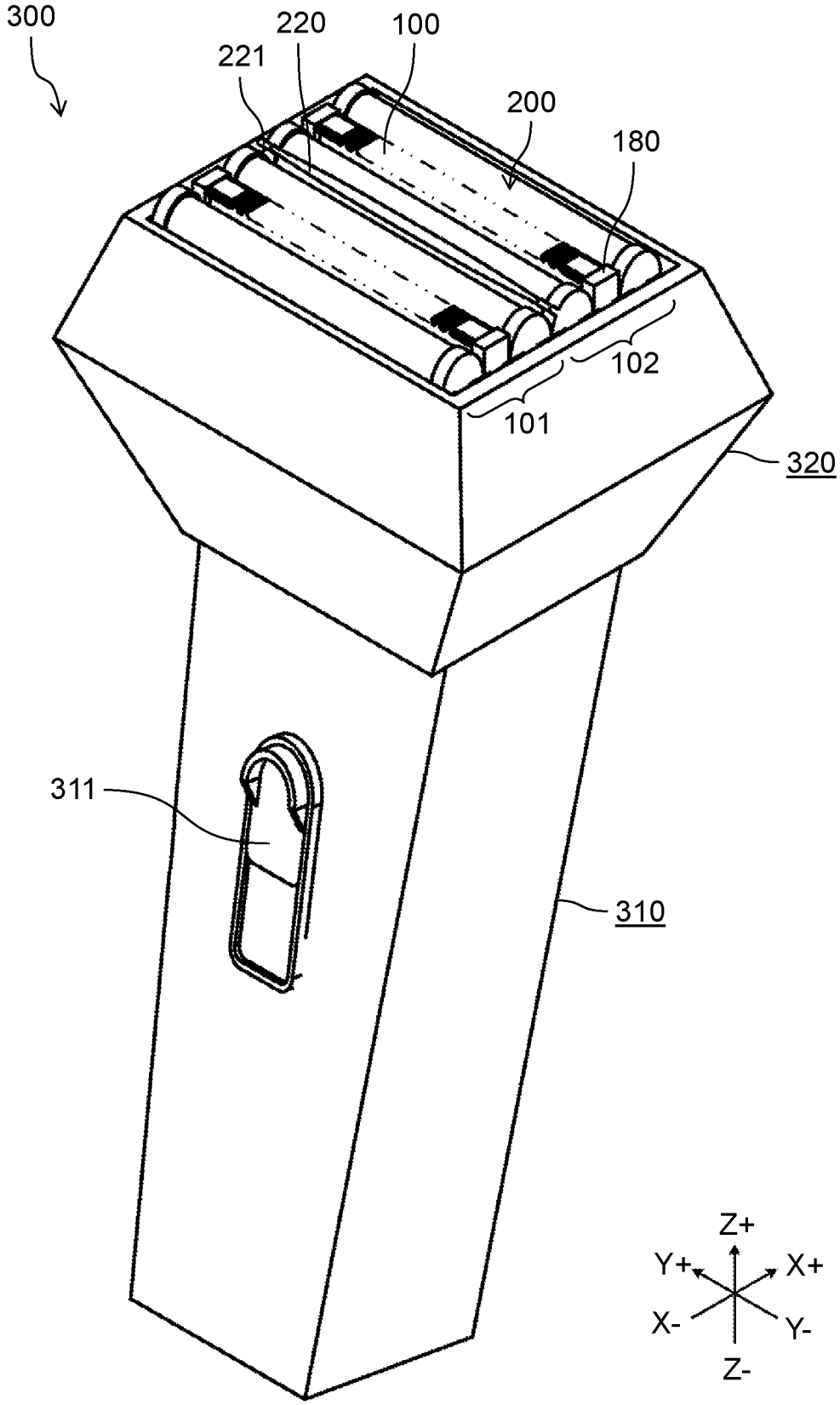
FIG. 1 is a perspective view illustrating an electric razor according to the present exemplary embodiment.

FIG. 1 is a perspective view illustrating an electric razor. Note that electric razor 300 has a portion that includes a rounded edge, and recesses and protrusions for preventing slippage, but these portions are not illustrated.

Electric razor 300 is a device that cuts and removes body hair such as beard using an electric blade, and includes grip part 310 and head part 320.

Grip part 310 is a part that a user grips when using electric razor 300. In the present exemplary embodiment, grip part 310 also functions as a housing that houses a control device that controls driving of shaving blades, a battery, and the like. Power switch 311 for turning on and off power supply is provided on an outer surface of grip part 310.

Head part 320 is a member to which blade unit 200 including blades for cutting body hair is detachably attached and which is connected to one end of grip part 310. In the present exemplary embodiment, head part 320 is relatively operably connected to grip part 310. In the present exemplary embodiment, a Y-axis direction is a direction in which an outer blade and sliding member 220 extend, an X-axis direction is a direction in which the outer blade and sliding member 220 are arranged in parallel, and a Z-axis direction is a direction in which the outer blade is movable with respect to unit base 230 (see FIG. 2) when receiving an external force.

Figure 2:
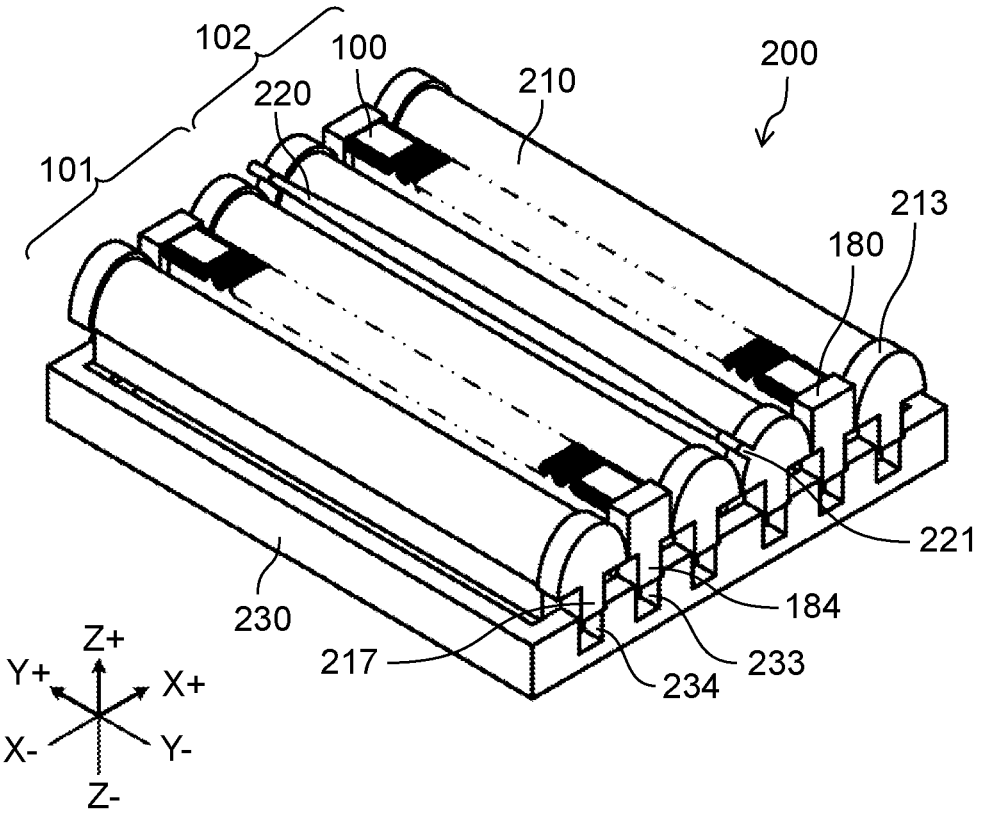
FIG. 2 is a perspective view illustrating a blade unit according to the present exemplary embodiment.

FIG. 2 is a perspective view illustrating blade unit 200. Blade unit 200 is a replacement unit with respect to head part 320 in a case where a blade or the like is degraded due to the use of electric razor 300, and includes comb-shaped outer blade 100, mesh outer blade 210, sliding member 220, and unit base 230. Note that comb-shaped outer blade 100 and mesh outer blade 210 may be collectively referred to as "outer blade".

In the present exemplary embodiment, blade unit 200 includes first set 101 and second set 102, each of which is a set of blades in which mesh outer blade 210 is disposed on each of both sides of comb-shaped outer blade 100 in a first direction (the Y-axis direction in the drawing) in which the outer blade extends, a second direction (the Z-axis direction in the drawing) in which the outer blade moves with respect to unit base 230, and a direction in which a plurality of outer blades are arranged side by side in parallel, that is, a third direction (the X-axis direction in the drawing) intersecting the first direction and the second direction. First set 101 includes three outer blades with different functions. First mesh outer blade 210 suitable for shaving short hair, comb-shaped outer blade 100 suitable for shaving long hair, and second mesh outer blade 210 suitable for shaving curly beards in addition to shaving short hair are arranged in this order along the third direction. Second set 102 also includes three outer blades with the same configuration as first set 101. First set 101 and second set 102 are attached to unit base 230 so as to be symmetrical with respect to a plane including the first direction and the second direction to constitute six outer blades. With such an arrangement, comb-shaped outer blade 100 is disposed next to mesh outer blade 210 in any of the moving directions (the X-axis direction in the drawing) of electric razor 300 during shaving, and even in a case where body hair in a narrow area such as under the nose is shaved, comb-shaped outer blade 100 comes into contact with the skin, and can scoop up and cut relatively long body hair.

Figure 3:
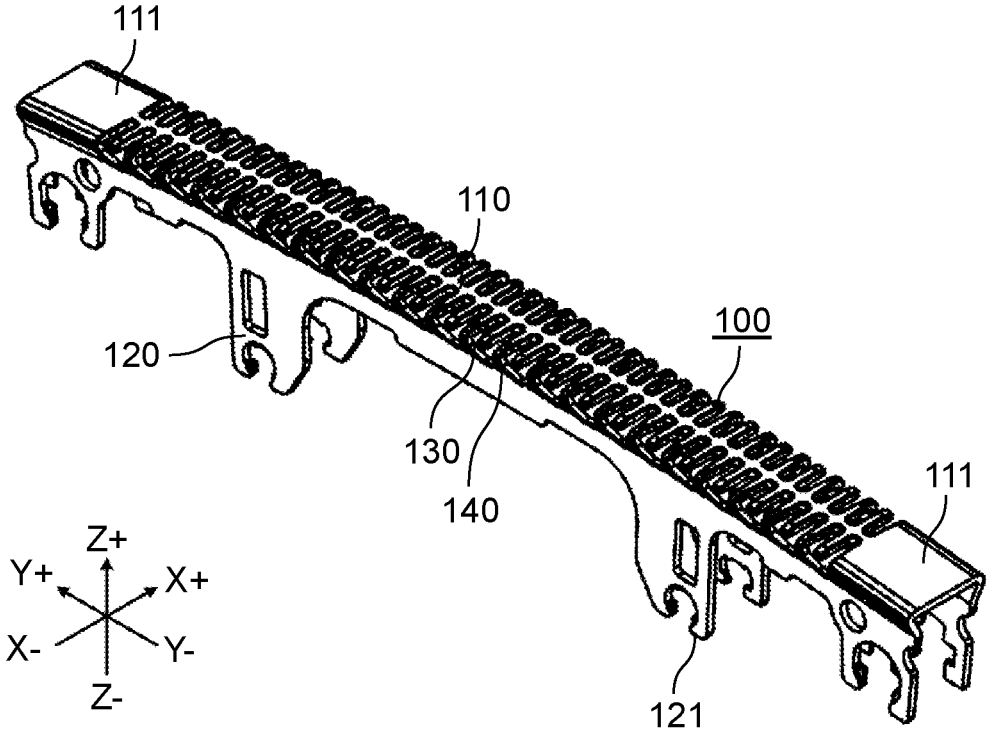
FIG. 3 is a perspective view illustrating a comb-shaped outer blade according to the present exemplary embodiment.
Figure 4:
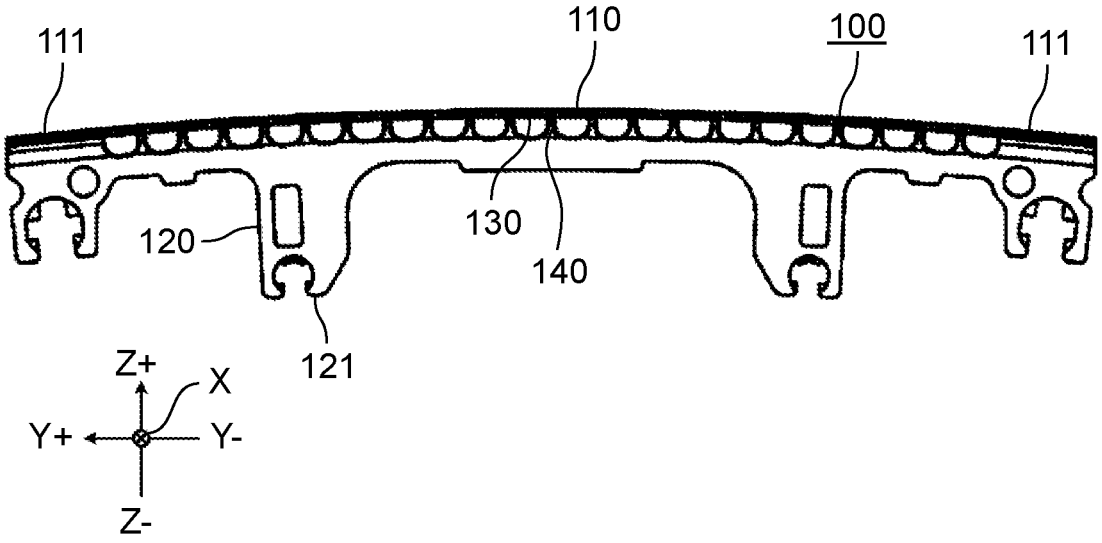
FIG. 4 is a side view of the comb-shaped outer blade according to the present exemplary embodiment.

FIG. 3 is a perspective view illustrating comb-shaped outer blade 100. FIG. 4 is a side view of comb-shaped outer blade 100. Comb-shaped outer blade 100 is an outer blade attached to electric razor 300, and includes base part 110, attachment part 120, open blade part 130, and bent blade part 140. According to the present exemplary embodiment, base part 110, attachment part 120, open blade part 130, and bent blade part 140 are integrally formed in comb-shaped outer blade 100 by punching and bending a sheet metal by pressing. Note that the method of processing comb-shaped outer blade 100 can be sintering, injection molding, etching, or electroforming, or comb-shaped outer blade 100 can be prepared by welding two members.

Base part 110 is a rod-shaped portion extending in the first direction (the Y-axis direction in the drawing), and includes long end part 111 that has the same bent shape as bent blade part 140 and is longer than bent blade part 140 in the first direction at both end portions of base part 110. In the present exemplary embodiment, base part 110 is curved in an arc shape such that a central portion protrudes forward (a Z+ side in the drawing) from both end portions in a plane (a YZ plane in the drawing) extending in the first direction and the second direction orthogonal to the first direction. A plurality of open blade parts 130 and a plurality of bent blade parts 140 are arranged along the curve of base part 110, accordingly. Since comb-shaped outer blade 100 is protrudingly curved, comb-shaped outer blade 100 can be fitted to a recessed part such as under a human's jaw, and shaving efficiency can be improved.

Attachment part 120 is a plate-shaped part extending in the first direction and the second direction orthogonal to the first direction. In the present exemplary embodiment, attachment part 120 includes outer blade engagement claw 121 that engages with outer blade protrusion 183 of comb-blade holding member 180, which will be described later (see FIG. 8).

Figure 5:
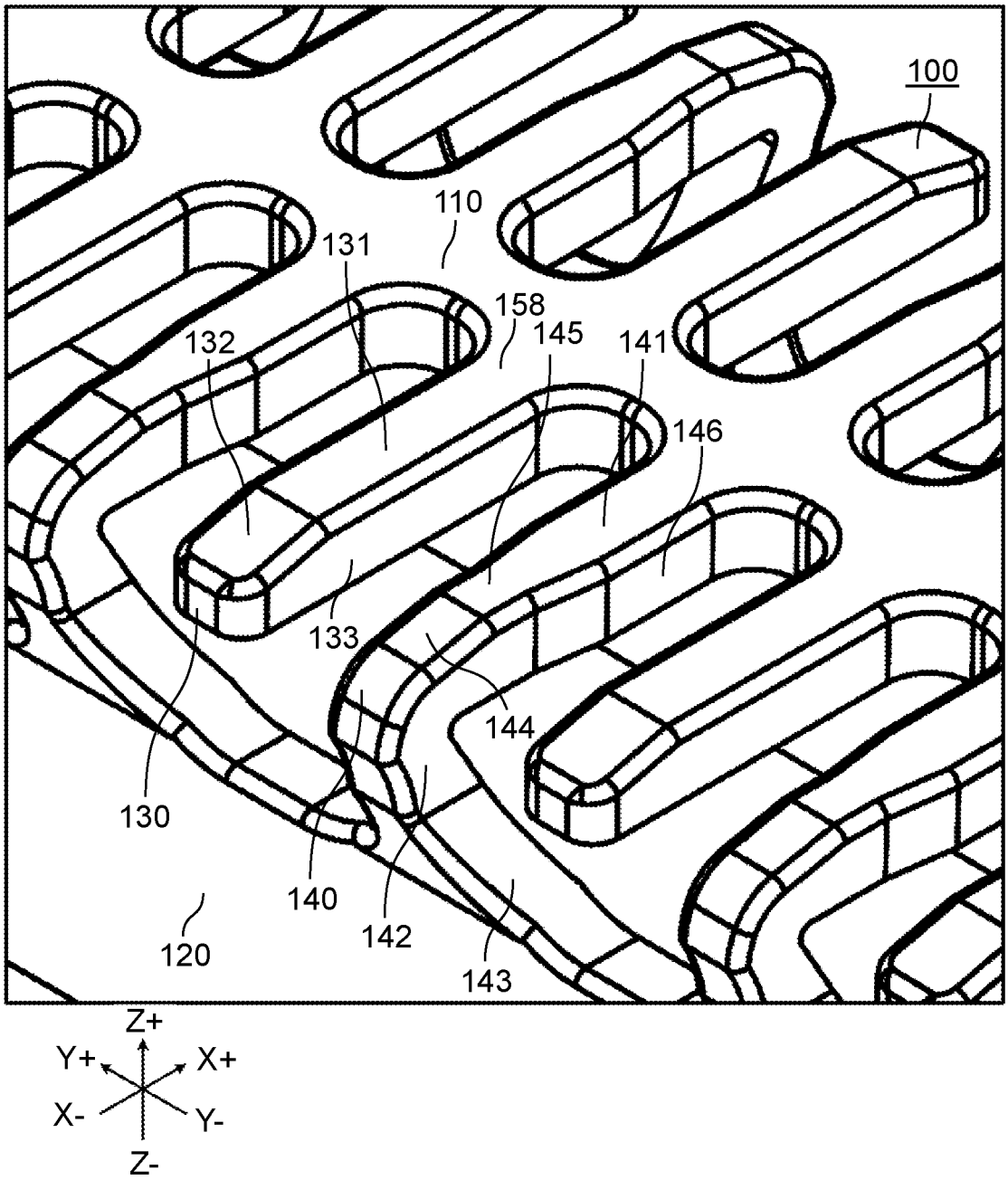
FIG. 5 is a perspective view illustrating a vicinity of an open blade part and a bent blade part according to the present exemplary embodiment.
Figure 6:
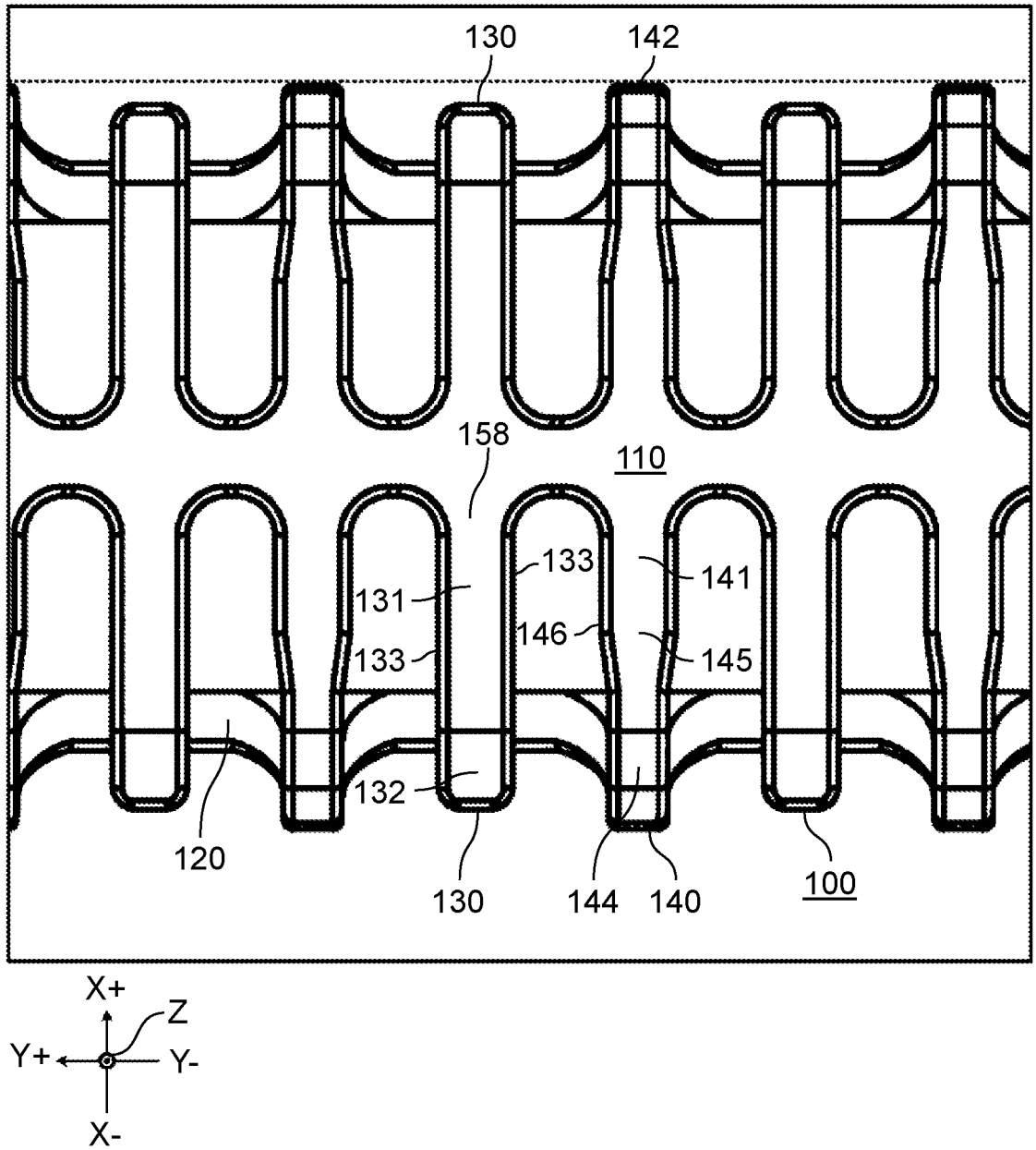
FIG. 6 is a plan view illustrating the vicinity of the open blade part and the bent blade part according to the present exemplary embodiment.

FIG. 5 is a perspective view illustrating the vicinity of open blade part 130 and bent blade part 140. FIG. 6 is a plan view illustrating the vicinity of open blade part 130 and bent blade part 140. Open blade part 130 is a cantilever-shaped part protruding from base part 110 in the third direction (the X-axis direction in the drawing) orthogonal to the first direction and the second direction. Open blade part 130 scoops up so-called flat-lying body hair or the like with a distal end in an open state, guides the body hair to the space between open blade part 130 and an adjacent blade part, and cuts the body hair together with first inner blade 170 that relatively reciprocates. The details of first inner blade 170 will be described later (see FIG. 8).

In the present exemplary embodiment, open blade part 130 extends in the first direction and the third direction (the XY plane in the drawing), includes open upper surface part 131 that is flush with base part 110, and has a rectangular rod shape as a whole.

The distal end of open upper surface part 131 in the third direction includes open inclined surface part 132 that approaches attachment part 120 as being separated from base part 110. Open inclined surface part 132 allows a reduction in the thickness (the length in the Z-axis direction in the drawing) of the distal end of open blade part 130, and even body hair extending closely along the skin surface can be effectively scooped up.

The corner portion of open upper surface part 131 and open side surface part 133 in open blade part 130 is rounded, so that open upper surface part 131 and open side surface part 133 are gently connected to each other. Furthermore, open side surface part 133 and open inclined surface part 132, and open inclined surface part 132 and the distal end surface are also gently connected by rounding or the like. This reduces the damage to the skin when comb-shaped outer blade 100 is rubbed against the skin surface.

Bent blade part 140 is disposed side by side with open blade part 130 in the first direction, and is connected to base part 110 and attachment part 120. In the present exemplary embodiment, bent blade part 140 and open blade part 130 are alternately arranged in parallel. The inventors have found through experiments that even in a case where bent blade part 140 and open blade part 130 are alternately arranged, the effect of scooping up body hair is similar to that obtained in a case where a plurality of open blade parts 130 are disposed between bent blade parts 140. In addition, as a result, the structural strength of comb-shaped outer blade 100 can be maintained high.

Bent blade part 140 includes protruding part 141 that protrudes from base part 110 along the third direction, bent part 142 that bends (curves) from a distal end of protruding part 141 toward attachment part 120, and connecting part 143 that is inclined so as to approach base part 110 in the third direction as being separated from bent part 142 in the second direction and connects bent part 142 and attachment part 120. Bent blade part 140 with such a shape forms an acute angle between protruding part 141 and connecting part 143, so that bent part 142 disposed at the distal end can effectively scoop up flat-lying body hair while reducing the damage to the skin, and guide the body hair between the bent blade part 140 and an adjacent blade.

In the present exemplary embodiment, as indicated by a broken line in FIG. 6, the end surfaces of a plurality of bent parts 142 are positioned at the same distance from base part 110 in the third direction, and are disposed at positions farther from base part 110 than the distal end surface of open blade part 130. As a result, the distal end of bent blade part 140 comes into contact with the skin earlier than the distal end of open blade part 130, so that comb-shaped outer blade 100 as a whole can achieve a high effect of scooping up body hair while reducing the damage to the skin.

In addition, bent blade part 140 includes bent inclined surface 144 disposed substantially in the same plane as the open inclined surface part of adjacent open blade part 130, and the thickness of bent part 142 in the second direction is reduced to improve the effect of scooping up body hair. In bent blade part 140, similarly to open blade part 130, the corner portion of bent upper surface part 145 and bent side surface part 146 is rounded, so that bent upper surface part 145 and bent side surface part 146 are gently connected to reduce the damage to the skin. The distal end of protruding part 141 of bent blade part 140 is narrower in width than base end part 158 (that is, the length in the first direction is short). Base end part 158 refers to a root portion of open blade part 130 connected to base part 110. Consequently, it is possible to enhance an effect of guiding scooped up body hair between open blade part 130 and an adjacent blade part.

Figure 7:
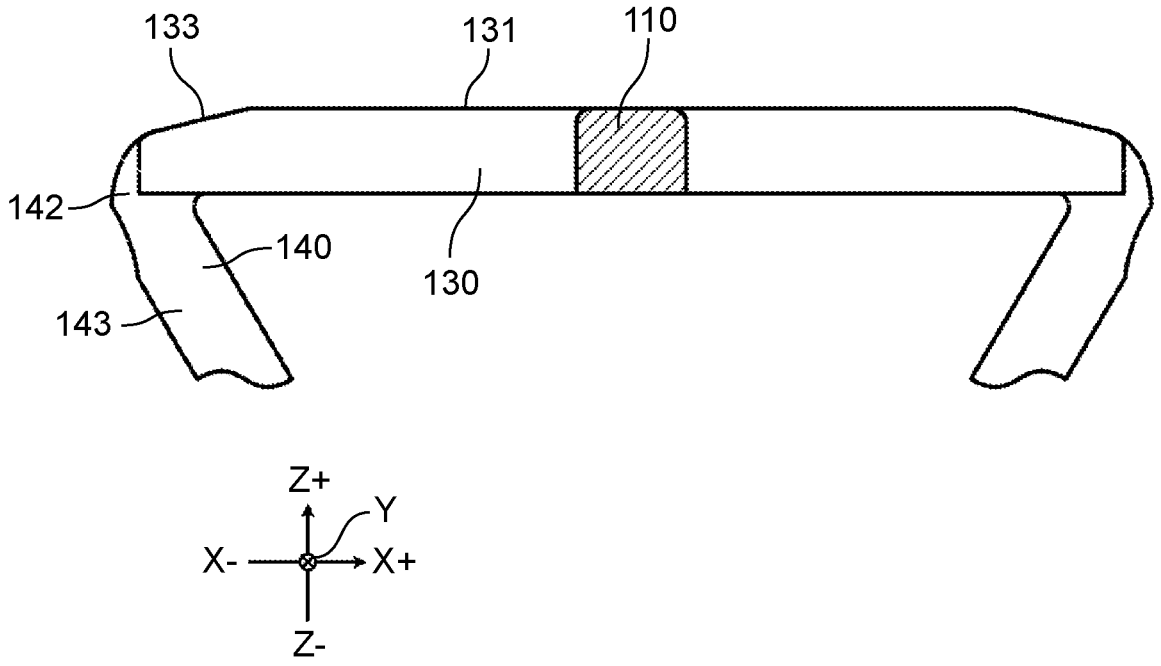
FIG. 7 is a diagram illustrating a state where the bent blade part and the open blade part are arranged in a first direction, as viewed from the first direction.

Furthermore, as illustrated in FIG. 7, when bent blade part 140 and open blade part 130 are arranged in the first direction, bent blade 140 is bent so that none of the parts of open blade part 130 protrude from bent blade part 140. As a result, the damage to the skin exerted by comb-shaped outer blade 100 is reduced.

Figure 8:
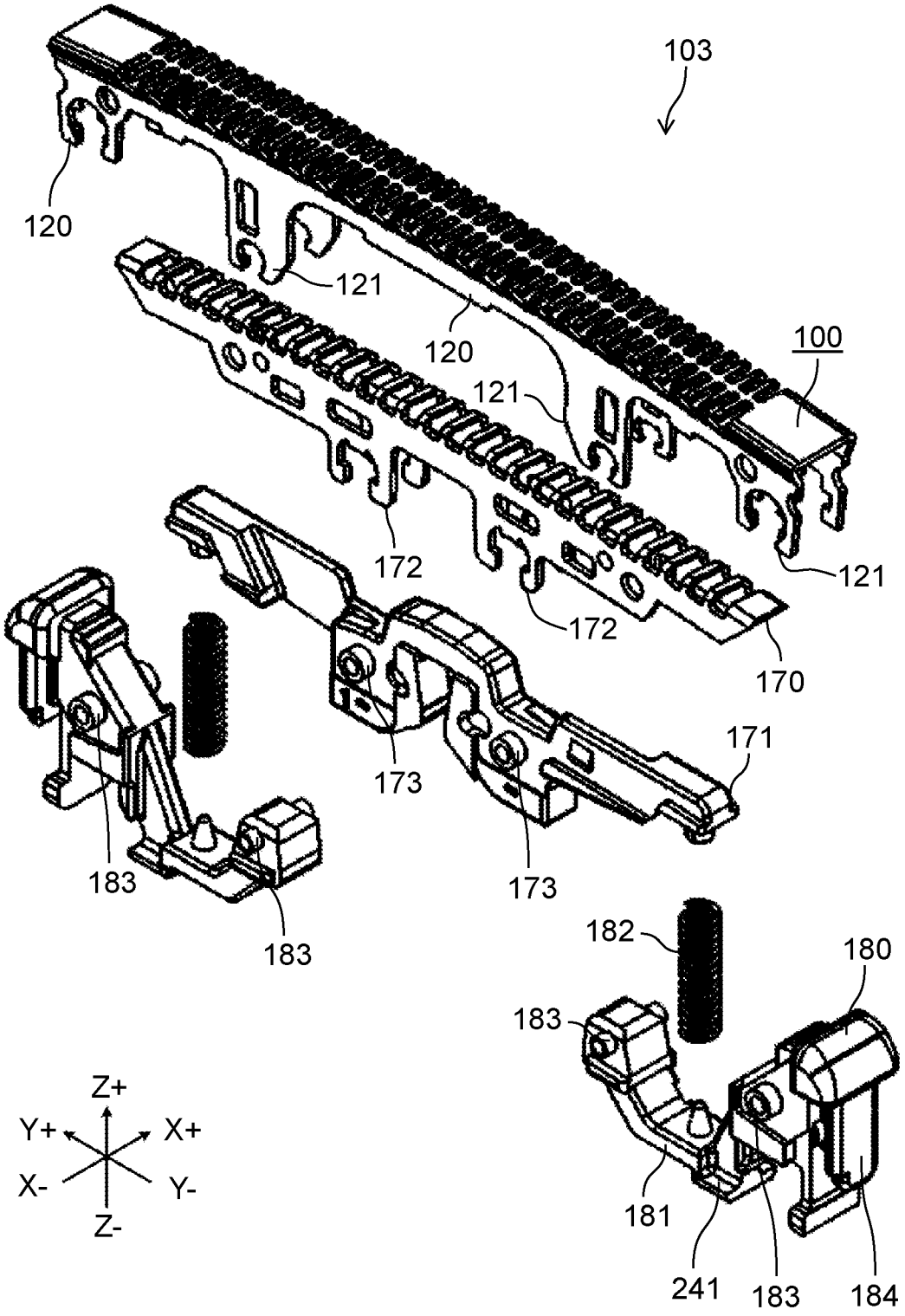
FIG. 8 is an exploded perspective view illustrating a comb-blade unit including the comb-shaped outer blade according to the present exemplary embodiment.
Figure 9:
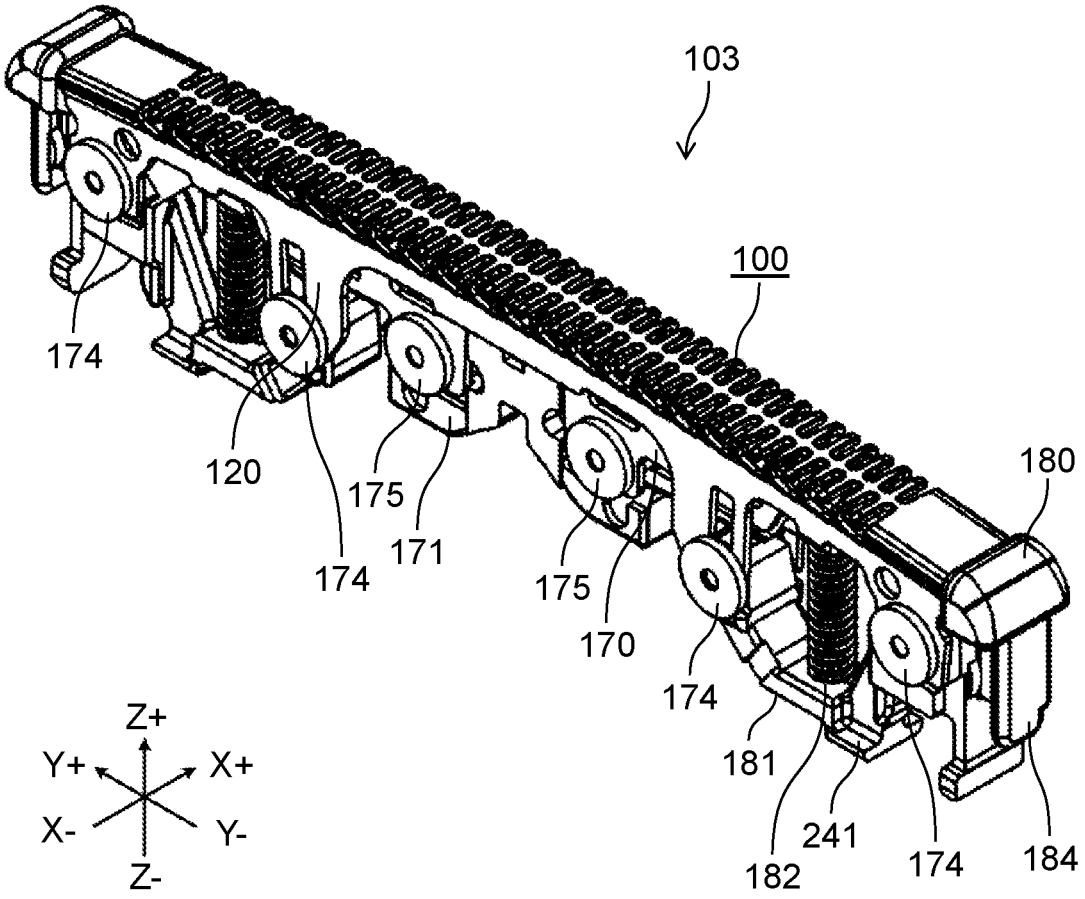
FIG. 9 is a perspective view illustrating the comb-blade unit according to the present exemplary embodiment in an assembled state.

FIG. 8 is an exploded perspective view illustrating comb-blade unit 103 including comb-shaped outer blade 100. FIG. 9 is a perspective view illustrating comb-blade unit 103 in an assembled state. As illustrated in these drawings, comb-blade unit 103 includes comb-shaped outer blade 100, first inner blade 170, comb-blade holding member 180, first urging member 182, and first joint member 171.

First inner blade 170 is disposed inside comb-shaped outer blade 100 (on a side opposite to a skin contact surface), and reciprocates in the first direction while rubbing against comb-shaped outer blade 100 to cut body hair inserted between adjacent blades of comb-shaped outer blade 100 (that is, between open side surface part 133 and bent side surface part 146). In the present exemplary embodiment, first inner blade 170 has a shape in which slits have been aligned in the first direction. First inner blade 170 is fixedly attached to first joint member 171 made of resin. In first inner blade 170, a drive connection part (not illustrated) extending from head part 320 is inserted into a recess provided at the center of first joint member 171, so that a reciprocating drive force is applied. The material of first joint member 171 is not limited to resin. The drive connection part is not limited as long as the function of drive transmission can be performed, and can be a metal pin or a molded article, and can have a round shape or a square shape.

Comb-blade holding member 180 is a resin member that is fixedly attached to each of both end portions of comb-shaped outer blade 100 in the first direction. Comb-blade holding member 180 integrally includes first opposing part 181 that opposes first inner blade 170 in the second direction. First urging member 182 connected to first joint member 171 is attached to first opposing part 181. First urging member 182 is a coil spring or the like, and allows first inner blade 170 to reciprocate while pressing first inner blade 170 against the back surface of comb-shaped outer blade 100 via first joint member 171 on the basis of first opposing part 181.

A method of joining comb-shaped outer blade 100 and comb-blade holding member 180 is not particularly limited. In the present exemplary embodiment, outer blade protrusion 183 of comb-blade holding member 180 engages with outer blade engagement claw 121 of attachment part 120, so that comb-shaped outer blade 100 and comb-blade holding member 180 are temporarily fixed to each other. Then, the distal end of outer blade protrusion 183 is melted and spread to form first melt-enlarged part 174, so that comb-shaped outer blade 100 and comb-blade holding member 180 are fixed to each other. Further, the material of comb-blade holding member 180 is not limited to resin, and a method of fixing comb-blade holding member 180 to comb-shaped outer blade 100 can be one of caulking, hook engagement, and welding, or a combination thereof.

A method of joining first inner blade 170 and first joint member 171 is not particularly limited. In the present exemplary embodiment, the method of joining first inner blade 170 and first joint member 171 is similar to the method of joining comb-shaped outer blade 100 and comb-blade holding member 180. First inner blade 170 made of metal includes inner blade engagement claw 172, and is temporarily fixed by hook-engaging with cylindrical inner blade engagement protrusion 173 provided on first joint member 171. Then, the distal end of inner blade engagement protrusion 173 is melted and spread to form second melt-enlarged part 175, so that first inner blade 170 and first joint member 171 are fixed to each other. Note that first melt-enlarged part 174 and second melt-enlarged part 175 are illustrated in a simplified manner in FIG. 9, but first melt-enlarged part 174 and second melt-enlarged part 175 are parts obtained by melting, spreading, and solidifying resin, and actually have a complicated shape.

Figure 10:
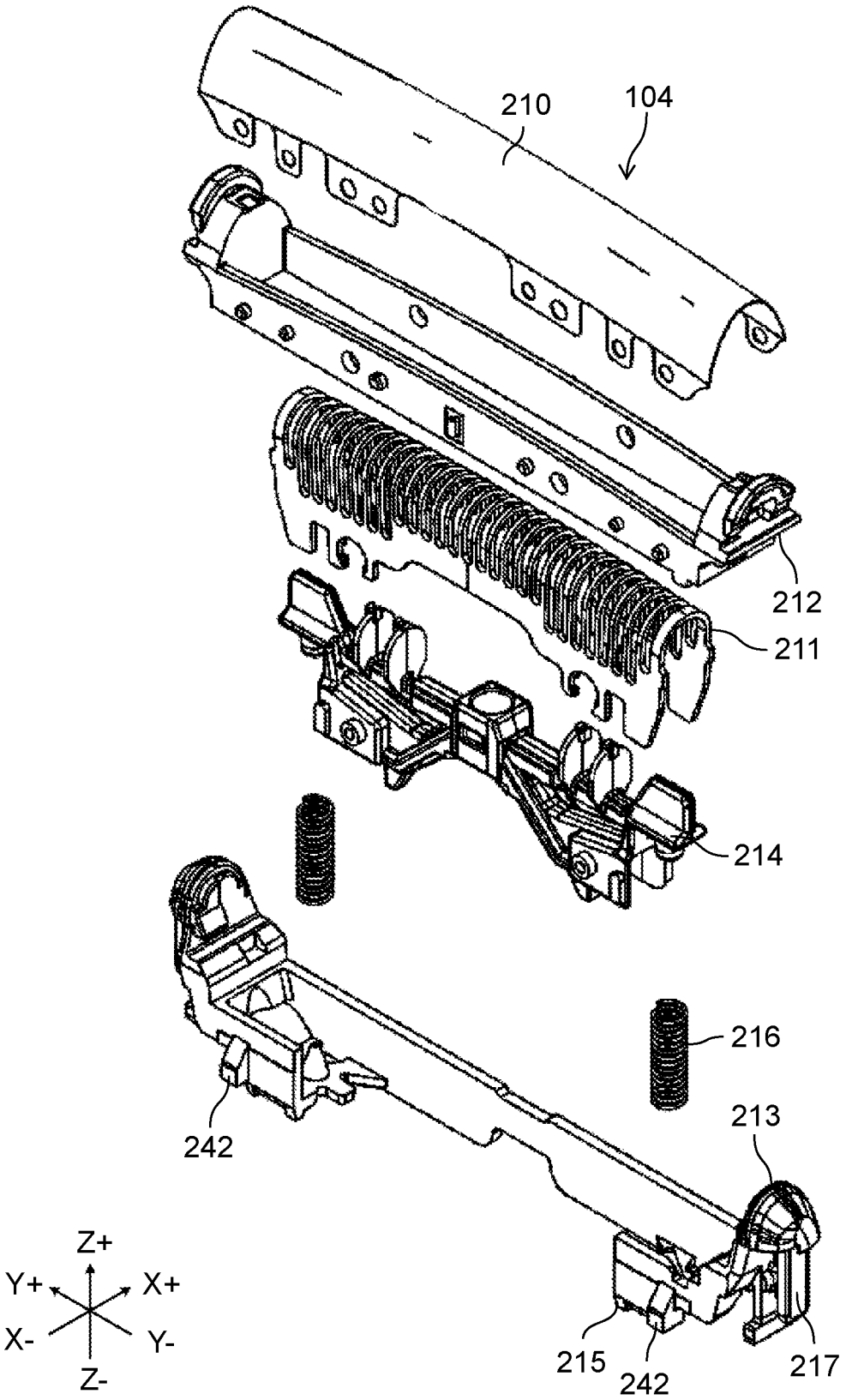
FIG. 10 is an exploded perspective view illustrating a mesh-blade unit including a mesh outer blade according to the present exemplary embodiment.
Figure 11:
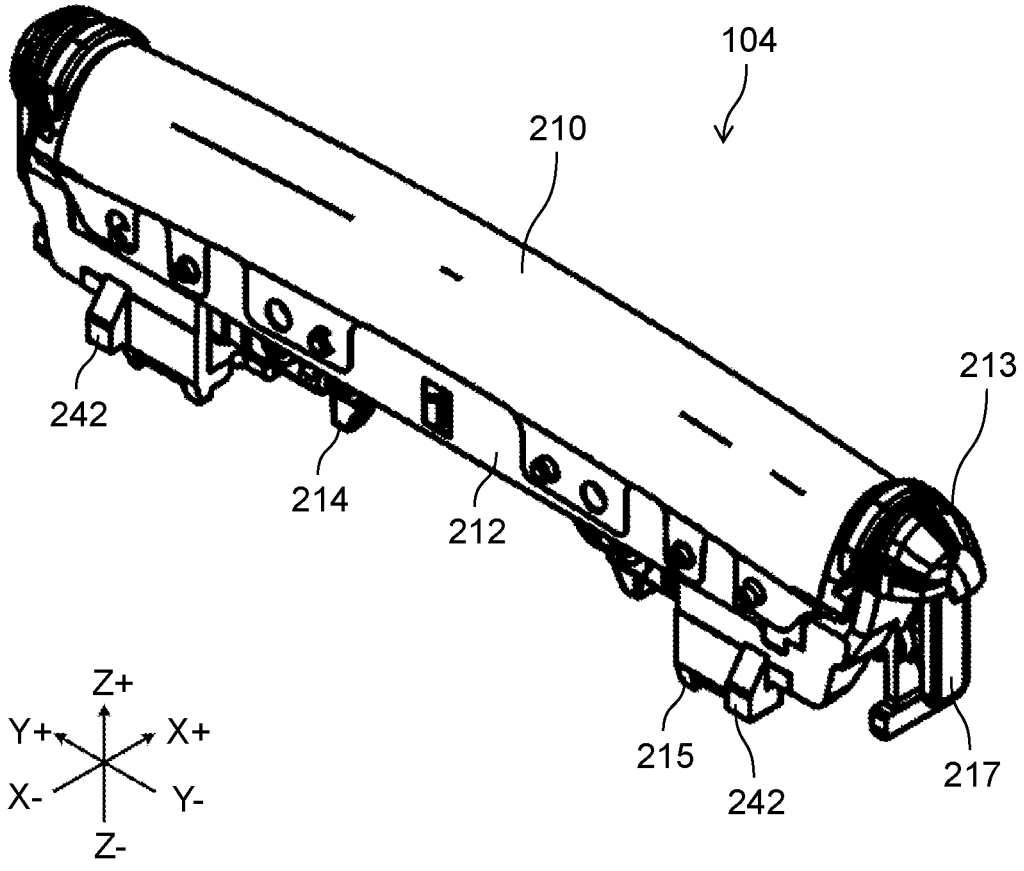
FIG. 11 is a perspective view illustrating the mesh-blade unit according to the present exemplary embodiment in the assembled state.

FIG. 10 is an exploded perspective view illustrating mesh-blade unit 104 including mesh outer blade 210. FIG. 11 is a perspective view illustrating mesh-blade unit 104 in an assembled state. As illustrated in these drawings, mesh-blade unit 104 includes mesh outer blade 210, second inner blade 211, mesh-blade fixing member 212, mesh-blade holding member 213, second urging member 216, and second joint member 214.

Mesh outer blade 210 is an outer blade for an electric razor attached to electric razor 300, extends in the first direction along comb-shaped outer blade 100, and is curved in a plane (an XZ plane in the drawing) extending in the second direction and the third direction. In the present exemplary embodiment, similarly to base part 110 of comb-shaped outer blade 100, mesh outer blade 210 is curved in an arc shape such that a central portion protrudes forward (the Z+ side in the drawing) from both end portions in a plane (the YZ plane in the drawing) extending in the first direction and the second direction. Further, similarly to comb-shaped outer blade 100, mesh outer blade 210 is protrudingly curved toward the Z+ side in the YZ plane in the drawing, and thus comb-shaped outer blade 100 can be fitted to a recessed part such as under a human's jaw and the shaving efficiency can be improved. Furthermore, comb-shaped outer blade 100 and mesh outer blade 210 are curved toward the Z+ side in the YZ plane in the drawing, and thus the effect can be further enhanced.

Mesh outer blade 210 is an outer blade that has a semi-cylindrical shape and has a plurality of through-holes in a mesh shape, and is used for cutting relatively short body hair. In the present exemplary embodiment, mesh outer blade 210 is formed by processing a large number of through-holes into a sheet metal thinner than the sheet metal constituting comb-shaped outer blade 100 by pressing, and is fixed to mesh-blade fixing member 212 made of resin so as to maintain a curved state. Note that the method of processing mesh outer blade 210 can be sintering, injection molding, etching, or electroforming, and the method of fixing mesh outer blade 210 and mesh-blade fixing member 212 can be a processing method such as welding with two members, or can be other processing methods or fixing methods.

Second inner blade 211 is disposed inside mesh outer blade 210, and reciprocates in the first direction while rubbing against mesh outer blade 210 to cut relatively short body hair inserted into the through-holes of mesh outer blade 210. In the present exemplary embodiment, second inner blade 211 has a shape in which arched blades curved in surfaces extending in the second direction and the third direction are arranged in the first direction with slits being interposed therebetween. Second inner blade 211 is fixedly attached to second joint member 214 made of resin. In second inner blade 211, a drive connection part (not illustrated) extending from head part 320 is inserted into a recess provided at the center of second joint member 214, so that a reciprocating drive force is applied. The material of the drive connection part can be a metal pin or a molded article, the shape of the drive connection part can be a round shape, a square shape, or the like, and the drive connection part is not particularly limited as long as the function of drive transmission function can be performed.

Mesh-blade holding member 213 is a resin member fixedly attached to each of both end portions of mesh outer blade 210. Mesh-blade holding member 213 integrally includes second opposing part 215 that opposes second inner blade 211 in the second direction. Second urging member 216 connected to second joint member 214 is attached to second opposing part 215. Second urging member 216 is a coil spring or the like, and allows second inner blade 211 to reciprocate while pressing second inner blade 211 against the back surface (that is, a side opposite to a skin contact surface) of mesh outer blade 210 via second joint member 214 on the basis of second opposing part 215. The material of mesh-blade holding member 213 is not limited to resin.

Figure 12:
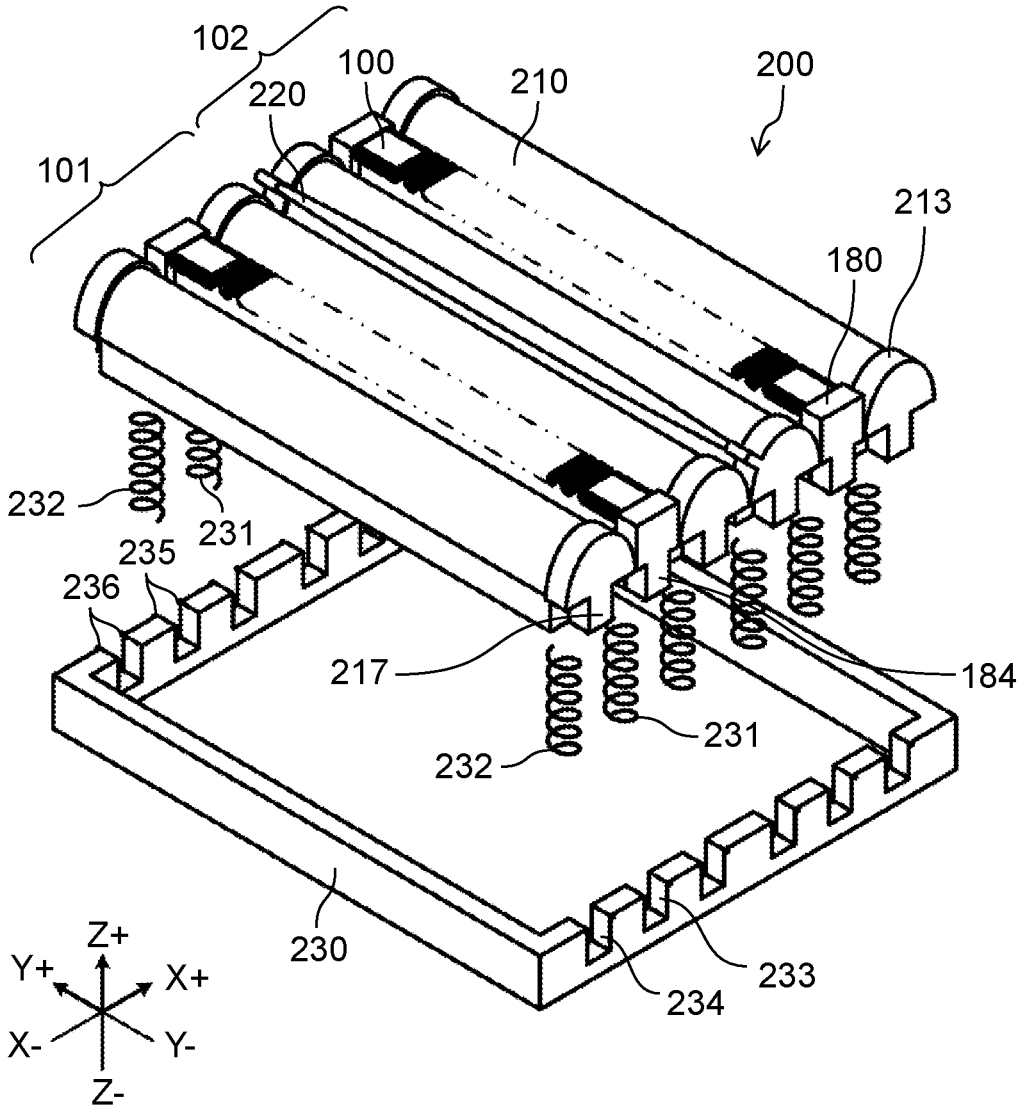
FIG. 12 is an exploded perspective view illustrating the blade unit according to the present exemplary embodiment.

FIG. 12 is an exploded perspective view illustrating blade unit 200. Unit base 230 is a member that holds comb-shaped outer blade 100 and mesh outer blade 210 so as to be movable in the second direction (the Z-axis direction in the drawing) and in a plane formed by the first direction and the second direction (obliquely). Here, "obliquely" means a direction intersecting the Z-axis in the YZ plane. In other words, the movable direction of comb-shaped outer blade 100 and mesh outer blade 210 includes not only a direction strictly along the Z-axis but also a direction substantially along the Z-axis. In the present exemplary embodiment, unit base 230 includes first guide part 233 that guides comb-shaped outer blade 100 in the second direction via first protrusion 184 of comb-blade holding member 180 in comb-blade unit 103.

Figure 13A:
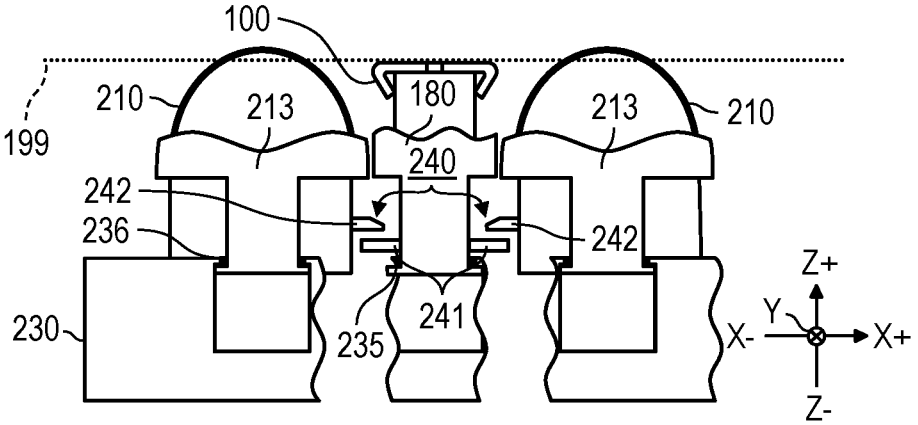
FIG. 13A is a diagram illustrating an operation state of an engagement mechanism according to the present exemplary embodiment.

Unit base 230 includes second guide part 234 that guides mesh outer blade 210 in the second direction via second protrusion 217 of mesh-blade holding member 213 in mesh-blade unit 104. First guide part 233 includes first restriction part 235 that restricts the amount of protrusion of the comb-blade unit 103 with respect to unit base 230, and second guide part 234 includes second restriction part 236 that restricts the amount of protrusion of mesh-blade unit 104 with respect to unit base 230. First restriction part 235 and second restriction part 236 have fixed-side protrusion 280 (see FIG. 13D) provided on a surface portion of unit base 230 on an outer (the Z+ direction in the drawing) side in the second direction. Fixed-side protrusion 280 is formed in a shape protruding in the third direction so as to cover a part of the groove provided as first guide part 233 and second guide part 234. Further, comb-blade holding member 180 of comb-blade unit 103 and mesh-blade holding member 213 of mesh-blade unit 104 include blade-unit-side protrusion 290 (see FIG. 13D) that protrudes in the third direction at its end in the second direction, and blade-unit-side protrusion 290 opposes fixed-side protrusion 280 in the second direction. With first restriction part 235 and second restriction part 236 with such a configuration, when comb-blade unit 103 and mesh-blade unit 104 are urged and moved outward in the second direction by comb-blade urging member 231 and mesh-blade urging member 232, respectively, and blade-unit-side protrusion 290 reaches the position of fixed-side protrusion 280, blade-unit-side protrusion 290 comes into contact with fixed-side protrusion 280, so that comb-blade unit 103 and mesh-blade unit 104 are restricted so as not to protrude further outward in the second direction. As illustrated in FIG. 13A, first restriction part 235 and second restriction part 236 are disposed so that comb-shaped outer blade 100 of comb-blade unit 103 restricted by first restriction part 235 does not protrude further than mesh outer blade 210 of mesh-blade unit 104 restricted by second restriction part 236.

As illustrated in FIG. 12, comb-blade urging member 231 is a member that urges comb-shaped outer blade 100 outward in the second direction (the Z+ direction in the drawing) with respect to unit base 230. In the present exemplary embodiment, comb-blade urging member 231 is a coil spring or the like, and is disposed between unit base 230 and comb-blade holding member 180 of comb-blade unit 103 at both end portions of comb-blade unit 103 in the first direction. In a state where comb-shaped outer blade 100 is not pressed in the second direction, a state where the movement of comb-blade unit 103 is restricted by first restriction part 235 provided on unit base 230 is maintained by the urging force of comb-blade urging member 231.

Mesh-blade urging members 232 is a member that urges mesh outer blade 210 outward in the second direction (the Z+ direction in the drawing) with respect to unit base 230. In the present exemplary embodiment, mesh-blade urging member 232 is a coil spring or the like, and is disposed between unit base 230 and mesh-blade holding member 213 of mesh-blade unit 104 at both end portions of mesh-blade unit 104 in the first direction. In a state where mesh outer blade 210 is not pressed in the second direction, a state where the movement of mesh-blade unit 104 is restricted by second restriction part 236 provided on unit base 230 is maintained by the urging force of mesh-blade urging member 232. As illustrated in FIG. 13A, the top portion of mesh outer blade 210 is disposed to protrude (the Z+ side in the drawing) further than comb-shaped outer blade 100 at any position in the first direction.

Figure 13B:
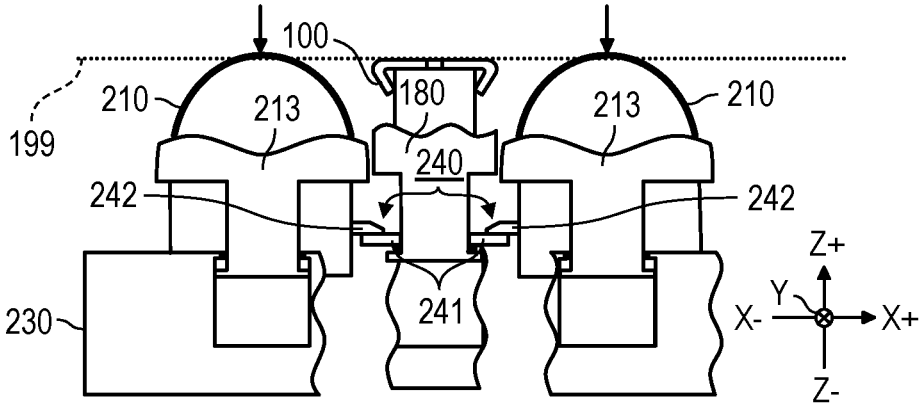
FIG. 13B is a diagram illustrating the operation state of the engagement mechanism according to the present exemplary embodiment.
Figure 13C:
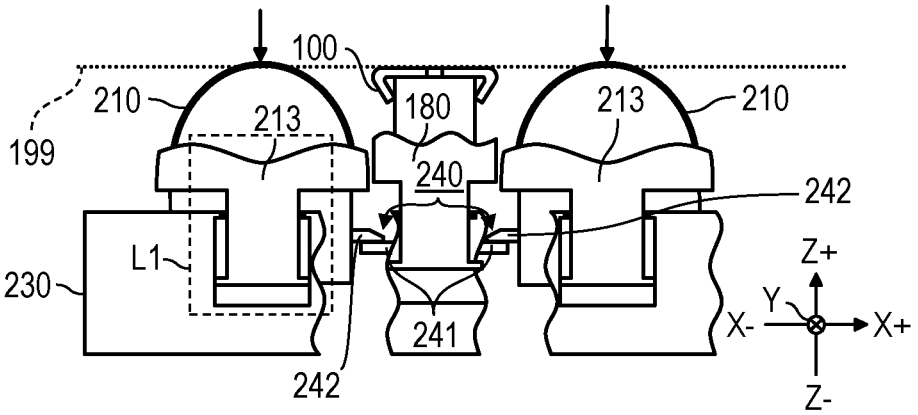
FIG. 13C is a diagram illustrating the operation state of the engagement mechanism according to the present exemplary embodiment.
Figure 13D:
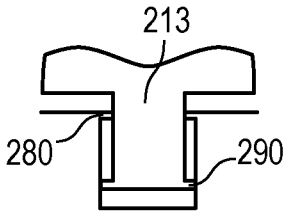
FIG. 13D is an enlarged view of a portion surrounded by broken line L1 in FIG. 13C.

FIGS. 13A to 13C are diagrams illustrating an operation state of engagement mechanism 240. FIG. 13D is an enlarged view of a portion surrounded by broken line L1 in FIG. 13C. Engagement mechanism 240 is a mechanism that moves comb-shaped outer blade 100 in a state where comb-shaped outer blade 100 does not protrude further than outer blade 210 with respect to unit base 230 when moving mesh outer blade 210 toward unit base 230 against the urging force of mesh-blade urging member 232. A specific mode of engagement mechanism 240 is not particularly limited, but in the present exemplary embodiment, engagement mechanism 240 includes first engagement part 241 and second engagement part 242.

First engagement part 241 is a member that can restrict the movement of comb-shaped outer blade 100 in the protruding direction (the Z+ direction in the drawing) by engaging with second engagement part 242 in the second direction. The arrangement position and attitude of first engagement part 241 are not particularly limited, but first engagement part 241 is provided in each of paired comb-blade holding members 180 included in comb-blade unit 103 so as to protrude toward mesh-blade unit 104.

Second engagement part 242 is a member that can move comb-shaped outer blade 100 toward unit base 230 against comb-blade urging member 231 by engaging with first engagement part 241 to transmit a force to comb-blade unit 103 in a case where mesh-blade unit 104 is pressed toward unit base 230 in the second direction. Second engagement part 242 is positioned outside first engagement part 241 (that is, on the upper side in the second direction), and is engaged with first engagement part 241 to restrict the movement of comb-shaped outer blade 100 in the second direction so that comb-shaped outer blade 100 does not protrude further than mesh outer blade 210. Second engagement part 242 is provided at both end portions of mesh-blade holding member 213 included in mesh-blade unit 104 in the first direction so as to protrude toward comb-blade unit 103.

An operation mode of engagement mechanism 240 will be described. In a case where mesh outer blade 210 and comb-shaped outer blade 100 are not pressed (see FIG. 13A), comb-shaped outer blade 100 and mesh outer blade 210 protrude most outwardly. In this state, mesh outer blade 210 protrudes further than comb-shaped outer blade 100. Note that in FIGS. 13A to 13C, the protruding position of comb-shaped outer blade 100 is indicated by a broken line at position 199. In this state, comb-shaped outer blade 100 and mesh outer blade 210 are movable independently in a sinking direction (that is, the Z— direction in the drawing).

Next, as illustrated in FIG. 13B, when electric razor 300 is lightly pressed against the skin, mesh outer blade 210 that generally protrudes further than comb-shaped outer blade 100 is pressed first, and mesh outer blade 210 starts to sink against mesh-blade urging member 232. When mesh outer blade 210 sinks until first engagement part 241 and second engagement part 242 in engagement mechanism 240 are engaged with each other, a pressing force is applied from second engagement part 242 to first engagement part 241, and comb-shaped outer blade 100 starts to sink in conjunction with mesh outer blade 210. Even in this state, mesh outer blade 210 protrudes slightly further than comb-shaped outer blade 100.

Furthermore, as illustrated in FIG. 13C, when electric razor 300 is pressed against the skin, the engagement state of first engagement part 241 and second engagement part 242 is maintained, and while mesh outer blade 210 remains protruding slightly further than comb-shaped outer blade 100, mesh outer blade 210 and comb-shaped outer blade 100 sink until restricted by unit base 230. In this state, comb-shaped outer blade 100 is independently movable in the sinking direction, but both mesh outer blades 210 move in the sinking direction together with comb-shaped outer blade 100. That is, engagement mechanism 240 restricts, in the direction in which comb-shaped outer blade 100 protrudes, the protrusion of comb-shaped outer blade 100 further than mesh outer blade 210 by the engagement of first engagement part 241 and second engagement part 242, but does not restrict the movement of comb-shaped outer blade 100 in the sinking direction, so that comb-shaped outer blade 100 may be pressed to sink depending on the skin shape.

Figure 14:
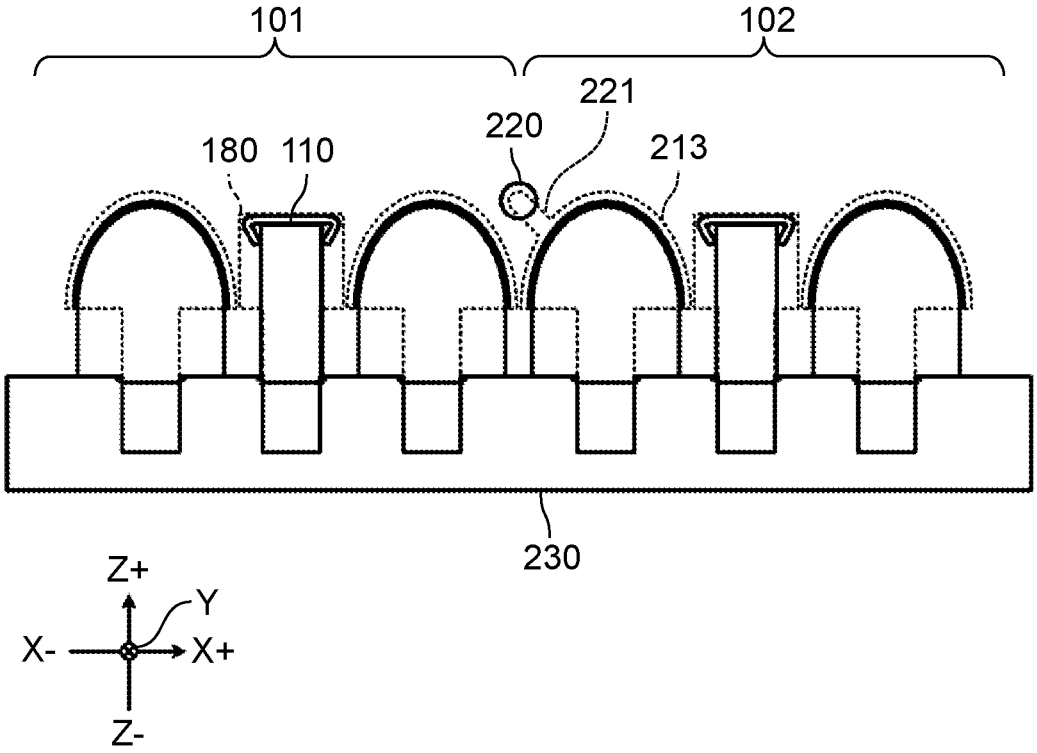
FIG. 14 is a side view of the blade unit in a state where a comb-blade holding member and a mesh-blade holding member according to the present exemplary embodiment are transparent.

FIG. 14 is a side view illustrating comb-blade holding member 180 and mesh-blade holding member 213 in a transparent state in blade unit 200. Sliding member 220 is a member that comes into contact with the skin surface when entire blade unit 200 is pressed against a wide skin surface and improves sliding on the skin when blade unit 200 is slid against the skin surface. The structure of sliding member 220 is not particularly limited, but in the present exemplary embodiment, sliding member 220 is a roller with an axis of rotation extending in the first direction (the Y-axis direction in the drawing). In the present exemplary embodiment, sliding member 220 has a bulging shape such that a central portion is larger in diameter than both end portions so as to correspond to the curved shape of mesh outer blade 210 in a plane (that is, the YZ plane in the drawing) extending in the first direction and the second direction. Furthermore, in a state where blade unit 200 is not pressed, sliding member 220 is disposed so as to protrude further than mesh outer blade 210 at any position in the first direction.

Sliding member 220 is attached to a holding member that holds the outer blade disposed in the vicinity. In the present exemplary embodiment, sliding member 220 is rotatably attached to bearing 221 that protrudes obliquely upward from one mesh-blade holding member 213 disposed closest to sliding member 220 toward adjacent mesh outer blade 210. As a result, sliding member 220 can sink in the second direction together with mesh outer blade 210, and can maintain a state of protruding slightly further than mesh outer blade 210. Note that although sliding member 220 is attached to bearing 221 in the present exemplary embodiment, sliding member 220 can be attached to, for example, unit base 230, but it is preferable to attach sliding member 220 to bearing 221 as in the present exemplary embodiment because the state of protrusion of sliding member 220 is more stabilized.

At least two outer blades are disposed on each of both sides of sliding member 220. In the present exemplary embodiment, the same number of outer blades, in this case three, are disposed on each side of sliding member 220. That is, the blade unit 200 includes an even number of outer blades, and sliding member 220 is disposed at the center thereof. That is, two or more outer blades are only required to be disposed on each of both sides of sliding member 220, and the number of outer blades disposed on each of both sides of sliding member 220 is not particularly limited.

Different types of outer blades are disposed on one side of sliding member 220. In the present exemplary embodiment, one outer blade is comb-shaped outer blade 100, and another is mesh outer blade 210. Blade unit 200 includes first set 101 and second set 102 in which mesh outer blade 210 is disposed on both sides of comb-shaped outer blade 100, and sliding member 220 is disposed between first set 101 and second set 102. That is, mesh outer blade 210 is disposed on both sides of sliding member 220 so as to be immediately adjacent to sliding member 220. As a result, sliding member 220 can be disposed in a valley formed by densely disposed mesh outer blades 210, and entire blade unit 200 can be made compact. In addition, when blade unit 200 is pressed against the skin, sliding member 220 can prevent the skin from entering the valley, and the damage to the skin can be reduced.

According to electric razor 300, blade unit 200, and comb-shaped outer blade 100 of the exemplary embodiment, high effect of scooping up body hair can be achieved, and body hair such as beard that grows long along the skin surface can be effectively cut. The body hair cut and shortened by comb-shaped outer blade 100 is further cut and shortened by mesh outer blade 210, so that a deep shaving effect can be enhanced while suppressing the damage to the skin.

Note that the present disclosure is not limited to the exemplary embodiment. For example, another exemplary embodiment achieved by arbitrarily combining the components described in the present specification or excluding some of the components may be an exemplary embodiment of the present disclosure. The present disclosure also includes modifications obtained by making various modifications conceivable by those skilled in the art without departing from the spirit of the present disclosure, that is, the meaning indicated by the wording described in the claims.

For example, although the case where open blade part 130 and bent blade part 140 are alternately arranged has been described, the plurality of bent blade parts 140 can be arranged between adjacent open blade parts 130, or the plurality of open blade parts 130 can be arranged between adjacent bent blade parts 140.

Although open blade parts 130 are arranged symmetrically and bent blade parts 140 are also arranged symmetrically with respect to base part 110, open blade part 130 and bent blade part 140 can be arranged side by side in the third direction.

Furthermore, the width (that is, the length in the first direction) of the distal end of open blade part 130 can be narrower than the width of base end part 158 like bent blade part 140.

Although blade unit 200 also including the inner blade has been exemplified, blade unit 200 does not need to include the inner blade.

Although first restriction part 235 and second restriction part 236 that restrict the amount of protrusion of comb-blade unit 103 and mesh-blade unit 104 with respect to unit base 230 have been described, the structure that restricts the amount of protrusion of comb-shaped outer blade 100 and mesh outer blade 210 is not limited thereto. For example, it is possible to provide a structure in which unit base 230 includes a groove that extends in the second direction and is closed at both ends in the extending direction, and either comb-blade unit 103 or mesh-blade unit 104 includes a protrusion that is inserted into the groove of unit base 230 and moves along the groove. In this case, the amount of protrusion is restricted by the protrusion coming into contact with the end part of the groove. Furthermore, contrary to the above structure with regard to the groove and the protrusion, unit base 230 can include the protrusion, and comb-blade unit 103 and mesh-blade unit 104 can include the groove.

The position of the restriction part that restricts the amount of protrusion of comb-blade unit 103 and mesh-blade unit 104 with respect to unit base 230 is not limited to unit base 230, comb-blade unit 103, and mesh-blade unit 104, and the restriction part can be provided at other positions depending on the amount of protrusion.

The present disclosure can be applied to an electric razor capable of shaving body hair of an animal including a human, such as a so-called electric shaver for shaving beard.

What is claimed is:

1. A comb-shaped outer blade configured to be attached to an electric razor, the comb-shaped outer blade comprising:

a base part that has a rod shape and extends in a first direction;

an attachment part that has a plate shape and extends in the first direction and a second direction intersecting the first direction;

open blade parts each of which has a cantilever shape and protrudes from the base part in a third direction which intersects the first direction and the second direction; and bent blade parts arranged alternately with the open blade parts in the first direction, the bent blade parts connecting the base part to the attachment part, wherein:

each of the bent blade parts comprises:

a protruding part that protrudes from the base part along the third direction;

a connecting part attached to the attachment part; and a bent part connecting the protruding part and the connecting part, and bent at an acute angle, the connecting part extends from the bent part to the attachment part so as to approach the base part in the third direction as leaving away from the bent part, each of the open blade parts comprises:

a first upper surface part that extends in the first direction and the third direction; and a first inclined surface part that has a flat upper surface and extends from a distal end of the upper surface part in the third direction and the flat upper surface inclines so as to approaches the attachment part in the second direction as leaving away from the base part, and a thickness of the first inclined surface part decreases as leaving away from the first upper surface part.

2. The comb-shaped outer blade according to claim 1, wherein an end surface of the bent part is disposed at a position farther from the base part than a distal end surface of each of the open blade parts in the third direction.

3. The comb-shaped outer blade according to claim 1, wherein each of the bent blade parts comprises a second inclined surface that is disposed substantially in a same plane as the first inclined surface part.

4. The comb-shaped outer blade according to claim 1, wherein each of the open blade parts comprises:

a first side surface part that extends in the second direction and the third direction, and a first corner portion of the first upper surface part and the first side surface part are rounded.

5. The comb-shaped outer blade according to claim 1, wherein each of the bent blade parts comprises:

a second upper surface part that extends in the first direction and the third direction, and a second side surface part that extends in the second direction and the third direction, and a second corner portion of the second upper surface part and the second side surface part are rounded.

6. The comb-shaped outer blade according to claim 1, wherein each of the open blade parts and each of the bent blade parts are arranged alternately.

7. The comb-shaped outer blade according to claim 1, wherein the base part includes a central portion that is curved so as to protrude from both end portions of the base part in a plane extending in the first direction and the second direction, and the open blade parts and the bent blade parts are arranged along a curve of the base part.

8. A blade unit for an electric razor, the blade unit is configured to be detachably attached to the electric razor, the blade unit comprising:

the comb-shaped outer blade according to claim 1;

a slit inner blade that is disposed inside the comb-shaped outer blade; and a comb-blade holding member that holds the slit inner blade so as to be able to reciprocate with respect to the comb-shaped outer blade.

9. An electric razor comprising the comb-shaped outer blade according to claim 1.

10. The comb-shaped outer blade according to claim 1, wherein a width of the connecting part in the first direction increases as leaving away from the bent part.

11. The comb-shaped outer blade according to claim 1, wherein a portion of the base part between one of the open blade parts and adjacent one of the bent blade part is rounded.

* * * * *